US010455910B2

(12) United States Patent
Brantley

(10) Patent No.: US 10,455,910 B2
(45) Date of Patent: Oct. 29, 2019

(54) CANE WRAP AND WALKER SADDLE BAG

(71) Applicant: Leola Brantley, Rochester, NY (US)

(72) Inventor: Leola Brantley, Rochester, NY (US)

( * ) Notice: Subject to any disclaimer, the term of this patent is extended or adjusted under 35 U.S.C. 154(b) by 0 days.

(21) Appl. No.: 15/732,205

(22) Filed: Oct. 4, 2017

(65) Prior Publication Data

US 2019/0098971 A1 Apr. 4, 2019

(51) Int. Cl.
*A45B 9/00* (2006.01)
*A45B 3/00* (2006.01)

(52) U.S. Cl.
CPC ..... *A45B 9/00* (2013.01); *A45B 3/00* (2013.01); *A45B 2009/002* (2013.01)

(58) Field of Classification Search
CPC ..... A45B 9/00; A61H 3/00
USPC ..... 224/250, 407
See application file for complete search history.

(56) References Cited

U.S. PATENT DOCUMENTS 1,526,246 A * 2/1925 Simek ..... A45B 3/00 135/66
1,838,986 A * 12/1931 Callender ..... A45B 1/02 135/66
2,210,493 A * 8/1940 Lisi ..... A45B 3/00 135/66
2,682,904 A * 7/1954 Divine ..... A45C 15/00 135/66
3,957,071 A * 5/1976 Kenner ..... A61H 3/00 135/66
3,970,229 A * 7/1976 Norinsky ..... A45C 3/00 190/902
4,676,416 A * 6/1987 Harmon ..... A61H 3/00 135/67
4,720,027 A * 1/1988 Board ..... B62J 9/005 224/426
4,800,911 A * 1/1989 Endres ..... A61H 3/00 135/67
4,974,760 A * 12/1990 Miller ..... A61H 3/00 135/67
5,012,963 A * 5/1991 Rosenbaum ..... A61H 3/00 135/67

(Continued)

FOREIGN PATENT DOCUMENTS

CA 2454286 A1 * 6/2005 ..... A45B 9/00

*Primary Examiner* — Nathan J Newhouse
*Assistant Examiner* — Lester L Vanterpool
(74) *Attorney, Agent, or Firm* — Law Office of Paul B. Johnson; Paul Johnson

(57) ABSTRACT

Uniqueness: A convenience and security device that wraps around cane fastens with Velcro on both ends. Has pockets on exterior, handy for men who wish to eliminate bulky wallets and women who want to eliminate purses while visiting establishments where there is no space, holder, or extra chair to rest a purse or other objects. Cane Wrap storage compartments eliminate the hassle of juggling purses and/or keys along with cane and irritating pocket wallet bulge. Wrap, has an anti-slide stopper, pockets keep items discrete and safer, remains in view. Walker Saddle Bag is removable, with anti-slide strip, not made onto walker but has that option by being sewn on to attach. Has pockets, saddlebag is lightweight, can be used on other stable or mobile objects, i.e., bikes, wheelchairs, motorcycles, motorbikes, chairs, and baby chairs, can flap over recliners and sofas and flap over tables with towel bars or any bar in any room and be used for storage.

3 Claims, 2 Drawing Sheets

(56) References Cited

U.S. PATENT DOCUMENTS 5,026,194 A * 6/1991 Lewis ..... A23G 3/203 222/567
5,031,807 A * 7/1991 Tiffany ..... B62J 9/005 150/108
5,048,849 A * 9/1991 Mathews ..... B62B 3/10 135/67
D324,504 S * 3/1992 Olsen ..... D12/130
5,154,331 A * 10/1992 Sanders ..... A61G 5/10 224/275
5,340,005 A * 8/1994 Woods ..... A61H 3/00 135/66
D352,260 S * 11/1994 Adamo ..... D12/133
5,465,884 A * 11/1995 Bohl ..... A45B 1/00 135/66
5,526,836 A * 6/1996 Sigsworth ..... A45B 1/00 135/66
5,642,749 A * 7/1997 Perryman ..... A61H 3/02 135/66
5,941,437 A * 8/1999 Okumura ..... A45C 3/00 224/585
6,182,877 B1 * 2/2001 Rolfe ..... A45B 1/00 135/66
6,651,683 B1 * 11/2003 Hooks ..... A45F 5/00 135/66
6,942,130 B1 * 9/2005 Duva ..... A45F 3/00 135/66
6,966,470 B1 * 11/2005 Charlton ..... A45C 13/26 135/66
7,174,907 B2 * 2/2007 Goldsmith ..... A45B 1/00 135/16
7,243,667 B2 * 7/2007 Floriani ..... A61H 3/02 135/68
7,984,724 B1 * 7/2011 Eberle ..... A61H 3/04 135/66
9,283,137 B1 * 3/2016 White ..... A45C 15/00
2002/0056736 A1 * 5/2002 Conte ..... A61H 3/02 224/407
2005/0121481 A1 * 6/2005 Chiu ..... A61H 3/00 224/407
2005/0236448 A1 * 10/2005 Reader ..... A45B 3/10 224/407
2006/0137728 A1 * 6/2006 Floriani ..... A61H 3/02 135/66
2006/0226190 A1 * 10/2006 Green ..... A45B 1/00 224/407
2006/0254629 A1 * 11/2006 Goldsmith ..... A45B 1/00 135/66
2007/0228094 A1 * 10/2007 Bednarz ..... A61H 3/02 224/407
2007/0277864 A1 * 12/2007 Sussman ..... A45B 9/00 135/66
2007/0278271 A1 * 12/2007 Koren ..... A45C 3/00 224/407
2009/0184011 A1 * 7/2009 Krakauer ..... A45C 3/004 206/278
2011/0186470 A1 * 8/2011 Ganti ..... B65D 83/04 206/538
2013/0256357 A1 * 10/2013 Prosperie ..... A45C 11/00 224/572
2015/0036952 A1 * 2/2015 Pang ..... B65D 33/005 383/116
2016/0166069 A1 * 6/2016 Brawley ..... A45C 7/0095 224/603

* cited by examiner

CANE WRAP AND WALKER SADDLE BAG

CROSS-REFERENCE TO RELATED APPLICATIONS

This application claims priority of and incorporates by reference U.S. Provisional Patent Application 62/388,721 filed Feb. 5, 2016.

BACKGROUND OF THE INVENTION

(1) Technical Field

The present invention relates to a device that relinquishes the problem of a disabled person's need to carry large purses, bags, wallets and keys while using ambulatory equipment.

(2) Background Art

Purses, bags, wallets and other storage devices exist in the art.

SUMMARY

The invention is a system for practicality. A first embodiment of the system comprises plural compartments, folds over a walker and is secured by detachable hook-and-loop fasteners for transfer. The plural compartments hide money, cards, and keys, etc. This first embodiment is made from lightweight material for easy storage and use. This first embodiment has an anti-slippage strip and hook-and-loop fastening strips underneath to secure it in place. Depending on an individual's closest need, sizes will be 6 to 10 inches with plural pockets. The first embodiment is built to fit most walkers; depending on the size it can flap over a cane, wheelchairs, bikes, and other mobile and non-mobile transportation including a person's body as a carry-all with extra compartments.

In a second embodiment, a Compartmental Cane Wrap with a secure anti-slippage cane stop, plural pockets and hook-and-loop fasteners is designed to wrap around cane bottoms for easier transport of needed items. This second embodiment is detachable and lightweight for easy travel, handling and transfer.

BRIEF DESCRIPTION OF THE SEVERAL VIEWS OF THE DRAWING(S)

DETAILED DESCRIPTION OF THE INVENTION

Figure 1B:
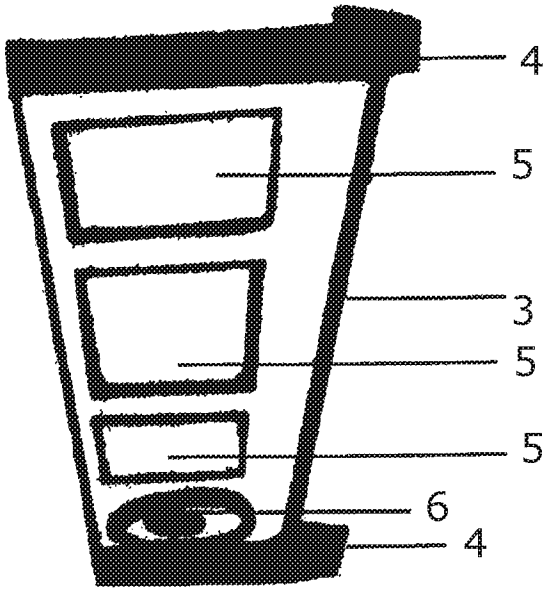
FIG. 1B shows a front view of a cane wrap with pockets.
Figure 1A:
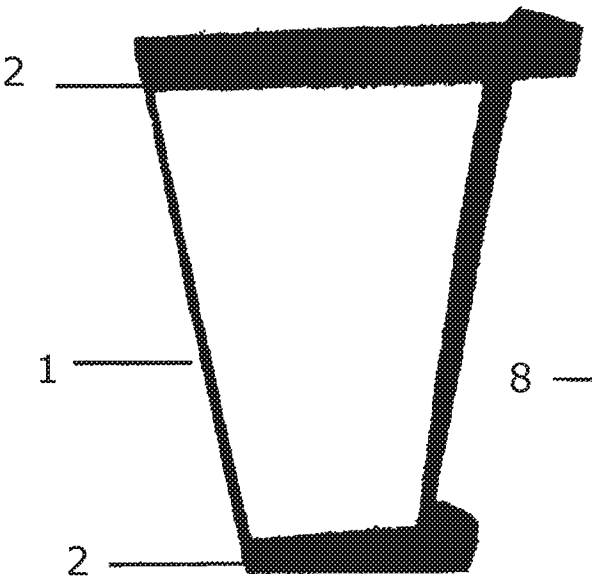
FIG. 1A shows a front view of a cane wrap.
Figure 2:
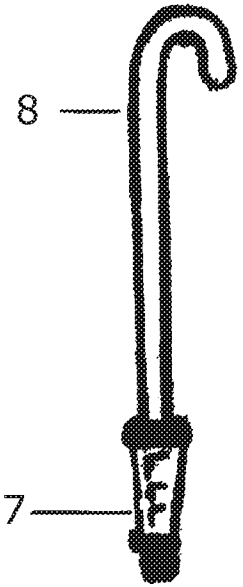
FIG. 2 shows the cane wrap of FIG. 1B attached to a cane for transport.
Figure 4:
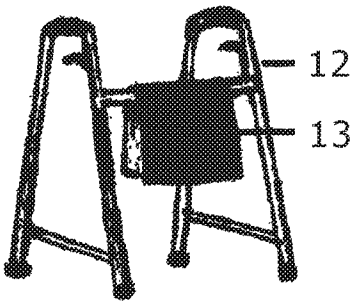
FIG. 4 shows the Saddle Bag of FIG. 3A attached to a walker.

In the cane wrap embodiment a transferable carrier for canes is described wherein the wrap is durable lightweight material that attaches to canes for easy assembly and effortless mobility, and transport of various items. The durable cloth design has top and bottom hook-and-loop fastener strip securers with a cane stop in bottom center to prevent slippage. The cane wrap has easy access compartments on the outside to hide money, cards, and keys. The compartmental device will be cone-shaped, detachable and for easy attachment and mobility for travel, will be assembled from lightweight materials in various colors (similar to upholstery cloth and built to fit most canes). The cane wrap will initially be assembled by hand. Sewing machines and thread will be used to ensure secure stitching (all to be professionally developed from my drawings, diagrams and supervision).

In the saddle bag embodiment, the Walker Saddle Bag is a transferable carrier built to fit almost any walker, but depending on size, can flap over canes and crutches, used on wheelchairs, bikes and other mobile and non-mobile transportation including the use as a body carry-all for extra compartments. The compartmental device is two-sided, detachable and lightweight for mobility and transfer. The saddle bag has hook-and-loop strip fasteners for anti-slippage, easy assembly, transfer and travel. Secure, accessible compartments are located on the outside to hide money, cards, and keys, etc. The compartmental device will be easily attachable for mobility, transfer, and travel, will be assembled from lightweight materials in various colors (similar to upholstery cloth) and built to fit most of the referenced items. The saddle bag will initially be assembled by hand. Sewing machines and thread will be used to ensure secure stitching (all to be professionally developed from my drawings, diagrams and supervision) as shown in the drawings. Individual drawing elements are described below.

FIG. 1A Cane Wrap

1. Element 1 shows a Cane Wrap body
2. Element 2 shows hook-and-loop fasteners

FIG. 1B

1. Element 3 shows another Cane Wrap Body
2. Element 4 shows hook-and-loop fasteners
3. Element 5 shows compartments
4. Element 6 shows a cane stop

FIG. 2

Figure 3B:
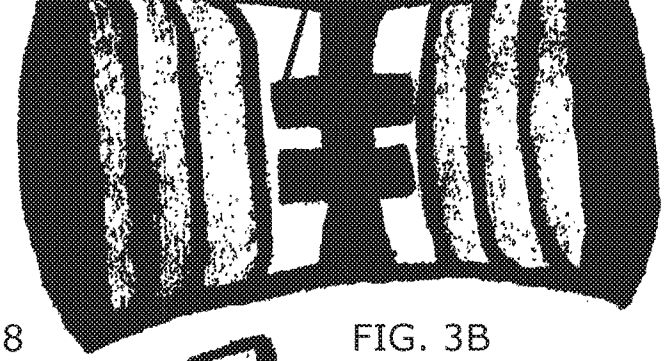
FIG. 3B shows an interior view of the Saddle Bag of FIG. 3A.
Figure 3A:
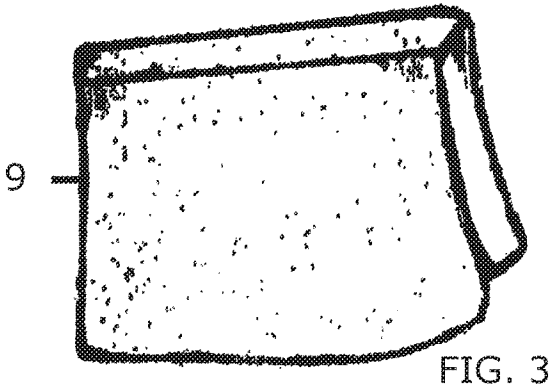
FIG. 3A shows a front view of a Saddle Bag.
Figure 3C:
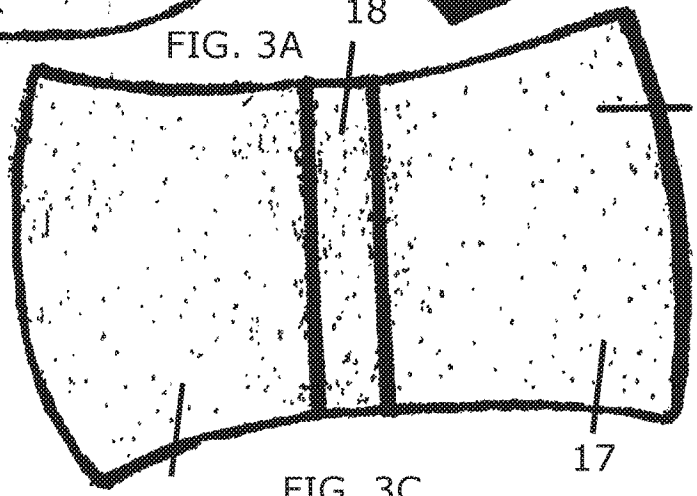
FIG. 3C shows a full exterior of the Saddle Bag of FIG. 3A.
Figure 5:
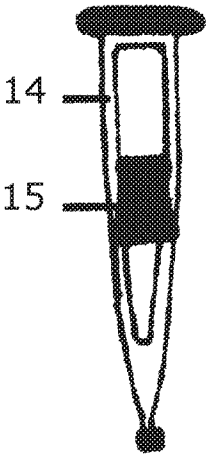
FIG. 5 shows the Saddle Bag of FIG. 3A on a crutch hand rest.

1. Element 7 shows a Cane Wrap attached to a cane
2. Element 8 shows a cane FIG. 3A Walker Saddle Bag 1. Element 9 shows Saddle Bag exterior—closed

FIG. 3B

1. Element 10 shows Saddle Bag Compartments
2. Element 11 shows hook-and-loop fasteners

FIG. 3C

1. Element 9 shows Saddle Bag exterior—opened
2. Element 16 shows a first flap
3. Element 17 shows a second flap
4. Element 18 shows a center portion

FIG. 4

1. Element 12 shows a walker
2. Element 13 shows a Walker Saddle Bag attached to a walker

FIG. 5

1. Element 14 shows a crutch
2. Element 15 shows a Walker Saddle Bag attached to a crutch

The invention claimed is:

1. A walker saddle bag, consisting of:

a first flap and a second flap coupled together with a central portion;

an exterior surface defined by the first flap, the second flap, and the central portion;

an interior surface defined by the first flap, the second flap, and the central portion;

a single column of compartments formed on an interior of the first flap;

a single column of compartments formed on an interior of the second flap, and;

one or more hook-and-loop fasteners formed on the interior surface at the central portion and configured to removably secure the central portion around a horizontal bar of one of a walker and a crutch;

wherein each of the compartments on the interior of the first flap comprises a longest length parallel with a longest length of the central portion, and wherein each of the compartments on the interior of the second flap comprises a longest length parallel with the longest length of the central portion.

2. A walker saddle bag, consisting of:

a first flap and a second flap coupled together with a central portion;

an exterior surface defined by the first flap, the second flap, and the central portion;

an interior surface defined by the first flap, the second flap, and the central portion;

a single column of compartments formed on an interior of the first flap;

a single column of compartments formed on an interior of the second flap, and;

one or more hook-and-loop fasteners formed on the interior surface at the central portion and configured to removably secure the central portion around a horizontal bar of one of a walker and a crutch;

wherein the compartments of the first flap and of the second flap are configured to receive money, credit cards, and keys, and wherein all the compartments of the first flap and all the compartments of the second flap are equally sized, wherein the plurality of compartments of the first flap are organized in a first single column, and wherein the plurality of compartments of the second flap are organized into a second single column; and wherein the first single column and second single column form a single combined column when the walker saddle bag is in an open configuration.

3. A walker saddle bag, comprising:

a first flap and a second flap coupled together with a central portion;

an exterior surface defined by the first flap, the second flap, and the central portion;

an interior surface defined by the first flap, the second flap, and the central portion;

a plurality of compartments formed on an interior of the first flap;

a plurality of compartments formed on an interior of the second flap, and;

one or more hook-and-loop fasteners formed on the interior surface at the central portion and configured to removably secure the central portion around a horizontal bar of one of a walker, a crutch, a wheelchair, and a bike;

wherein each compartment of the first flap and of the second flap comprises an opening providing access thereto, and wherein none of the openings are collinear when the walker saddle bag is in a fully opened configuration; and wherein the plurality of compartments of the first flap and second flap are organized into two columns when the walker saddle bag is in a folded configuration and wherein the plurality of compartments of the first flap and second flap are organized into a single column when the walker saddle bag is in an open configuration.

* * * * *